US008274446B2

(12) United States Patent
Maxhimer et al.

(10) Patent No.: US 8,274,446 B2
(45) Date of Patent: Sep. 25, 2012

(54) LIGHTWEIGHT ANTENNA ATTACHMENT STRUCTURE

(75) Inventors: Kyle W. Maxhimer, Hermosa Beach, CA (US); David T. Winslow, Culver City, CA (US); Larry L. Lai, Walnut, CA (US); Derek Pruden, Redondo Beach, CA (US)

(73) Assignee: Raytheon Company, Waltham, MA (US)

( * ) Notice: Subject to any disclaimer, the term of this patent is extended or adjusted under 35 U.S.C. 154(b) by 313 days.

(21) Appl. No.: 12/793,448

(22) Filed: Jun. 3, 2010

(65) Prior Publication Data

US 2011/0298687 A1 Dec. 8, 2011

(51) Int. Cl.
*H01Q 1/12* (2006.01)
*H01Q 21/00* (2006.01)

(52) U.S. Cl. ..... 343/878; 343/879

(58) Field of Classification Search ..... 343/878, 343/879

See application file for complete search history.

(56) References Cited

U.S. PATENT DOCUMENTS

| | | | | |
|---|---|---|---|---|
| 3,283,401 | A | 11/1966 | Pijls | |
| 5,278,574 | A * | 1/1994 | Zimmerman et al. | 343/778 |
| 6,087,991 | A * | 7/2000 | Kustas | 343/700 MS |
| 2006/0238428 | A1* | 10/2006 | Schmitt et al. | 343/713 |
| 2009/0179813 | A1* | 7/2009 | Turner et al. | 343/793 |

FOREIGN PATENT DOCUMENTS

| | | | |
|---|---|---|---|
| DE | 14 00 875 | A1 | 5/1969 |
| JP | 2002 267922 | A | 9/2002 |
| JP | 2007 269183 | A | 10/2007 |
| WO | WO 2010/112601 | A1 | 10/2010 |

OTHER PUBLICATIONS

Raytheon Company, News Release, "DARPA Asks Raytheon to Develop Radar for 'Integrated Sensor Is Structure' Program", El Segundo, California, Aug. 8, 2006 (1 pg.).

Timothy Clark, "Integrated Sensor is Structure (ISIS)", http://www.darpa.mil/sto.space/isis.html, updated Mar. 5, 2009 (8. pgs.).

Evonik Industries, Product Information, ROHACELL Polymethacrylimide Foam, Nov. 2009 (6 pgs.).

Extended European Search Report for European Application No. 11160836.0, Extended European Search Report dated Nov. 18, 2011 and mailed Nov. 25, 2011 (5 pgs.).

Bamford et al., "Decoupling a Reflecting Layer From Its Support Structure", NASA, Oct. 1984 (1 pg.).

* cited by examiner

*Primary Examiner* — Hoang V Nguyen

(74) *Attorney, Agent, or Firm* — Christie, Parker & Hale, LLP

(57) ABSTRACT

The present invention relates to lightweight antenna arrays and more particularly to an attachment mechanism for attaching a lightweight antenna array to a structure. In one embodiment, an antenna structure includes a platform having a first coefficient of thermal expansion; an antenna panel having a second coefficient of thermal expansion different from the first coefficient, and having first and second opposite ends; and a support structure mounting the panel to the platform. The support structure includes a first spacer element with a first height at the first end of the panel, and a second spacer element with a second height less than the first height between the first and second ends of the panel; a first adhesive layer adhering each spacer element to the platform; and a second adhesive layer adhering each spacer element to the antenna panel. A yield strength of the adhesive layers is less than a yield strength of the spacer elements.

19 Claims, 4 Drawing Sheets

LIGHTWEIGHT ANTENNA ATTACHMENT STRUCTURE

STATEMENT REGARDING FEDERALLY SPONSORED RESEARCH OR DEVELOPMENT

This invention was made with Government support under Contract No. FA8750-06-C-0048 awarded by the Defense Advanced Research Projects Agency. The United States Government may have certain rights to this invention.

FIELD OF THE INVENTION

The present invention relates to lightweight antenna arrays and more particularly to an attachment mechanism for attaching a lightweight antenna array to a structure.

BACKGROUND

Antenna structures have been developed to provide lightweight antenna arrays including "active" or "phased" array antennas. However in many cases the lightweight materials and carefully calibrated electrical elements produce a delicate antenna structure. At the same time, these lightweight antenna structures may be deployed on platforms that are exposed to various thermal and structural loads and possibly harsh environmental conditions.

For example, one application for lightweight antenna structures is high-altitude surveillance, such as high-altitude balloons. During the balloon's flight, temperature conditions through the atmosphere may change considerably, causing the balloon material to expand or contract. The material of the balloon itself differs from the antenna structure and may have a different coefficient of thermal expansion. Due to the mismatch in thermal expansion between the balloon platform and its antenna payload, the balloon may expand more or less than the antenna structure, thereby stressing the joint or bond between the balloon and the antenna. These "thermal" stresses due to differential thermal expansion can cause failure of the joint or the antenna structure itself, or cause other problems such as warping or mis-alignment of the antenna structure. Prior attachment mechanisms include direct adhesive bonding, mechanical joints, and lanyards. Adhesively bonding the panel directly to the balloon material does not account for the thermal mismatch between the materials, or variations in the two surfaces (such as surface features on the panel, or curvature of the balloon). Rigid mechanical joints at the corners of the panels can lead to structural failure at the corners. Lanyards, loops, and other similar attachments may not be precise enough for alignment of the antenna array, and the antenna panels may bend, swing, or move out of place. These attachment structures can also add significant weight to the system.

Accordingly there is still a need for an attachment mechanism for attaching lightweight antenna structures to a platform exposed to various thermal and/or other stresses.

SUMMARY

The present invention relates to lightweight antenna arrays and more particularly to an attachment mechanism for attaching a lightweight antenna array to a structure with a different coefficient of thermal expansion. In one embodiment, an antenna system includes an array of antenna panels that are mounted to a platform structure, such as a high-altitude balloon. An attachment mechanism is provided to mount the antenna panels to the platform, providing a fixed structural mount while insulating the panels from the mismatch in thermal expansion. In one embodiment, the attachment mechanism comprises a support structure between the panels and the platform. The support structure includes a plurality of spacer elements that separate the antenna panels from the platform. The spacer elements are made of a stiff foam material and are adhered at one end to the platform and at the opposite end to an antenna panel. The spacer elements are located and dimensioned according to the thermal and structural properties of the antenna panels and the platform, in order to provide a strong structural mount for the panels while also spacing the panels away from the platform, thereby providing flexibility for the mismatch in thermal expansion between the two structures.

In one embodiment, an antenna structure includes a platform having a first coefficient of thermal expansion; an antenna panel having a second coefficient of thermal expansion different from the first coefficient, and having first and second opposite ends; and a support structure mounting the panel to the platform. The support structure includes a first spacer element with a first height at the first end of the panel, and a second spacer element with a second height less than the first height between the first and second ends of the panel; a first adhesive layer adhering each spacer element to the platform; and a second adhesive layer adhering each spacer element to the antenna panel. A yield strength of the adhesive layers is less than a yield strength of the spacer elements.

In one embodiment, an antenna structure includes a platform having a curved surface; an array of antenna panels; and first and second blocks mounting each panel to the curved surface. The first and second blocks have first and second heights, respectively, that are different from each other. Each block is adhered to the curved surface, and the blocks comprise a foam material. Each block is approximately 0.5 inches in width, and the blocks are spaced apart from each other by approximately 2-5 inches.

In one embodiment, a method of mounting an antenna panel to a platform includes providing a platform having a first coefficient of thermal expansion; providing an antenna panel having a second coefficient of thermal expansion different from the first coefficient, and having first and second opposite ends; and mounting the panel to the platform. Mounting the panel to the platform includes providing a first spacer element with a first height at the first end of the panel; providing a second spacer element with a second height less than the first height between the first and second ends of the panel; adhering each spacer element to the platform with a first adhesive layer; and adhering each spacer element to the antenna panel with a second adhesive layer. A yield strength of the adhesive layers is less than a yield strength of the spacer elements.

DETAILED DESCRIPTION

The present invention relates to lightweight antenna arrays and more particularly to an attachment mechanism for attaching a lightweight antenna array to a structure with a different coefficient of thermal expansion. In one embodiment, an antenna system includes an array of antenna panels that are mounted to a platform structure, such as a high-altitude balloon. The antenna panels have a higher coefficient of thermal expansion than does the platform structure, meaning that the material of the panels expands more with temperature than does the platform. Despite this mismatch in thermal expansion between the two structures, the antenna panels need to be firmly mounted to the platform in order to be properly oriented and aligned with each other.

According to an embodiment of the invention, an attachment mechanism is provided to mount the antenna panels to the platform, providing a fixed structural mount while insulating the panels from this mismatch in thermal expansion. The attachment mechanism acts as a buffer for thermal stresses. In one embodiment, the attachment mechanism comprises a support structure between the panels and the platform. The support structure includes a plurality of spacer elements that separate the antenna panels from the platform. The spacer elements are made of a stiff foam material and are adhered at one end to the platform and at the opposite end to an antenna panel. The spacer elements are located and dimensioned according to the thermal and structural properties of the antenna panels and the platform, in order to provide a strong structural mount for the panels while also spacing the panels away from the platform, thereby providing flexibility for the mismatch in thermal expansion between the two structures. The spacer elements provide a flexible link between the antenna panel and the platform.

Figure 1:
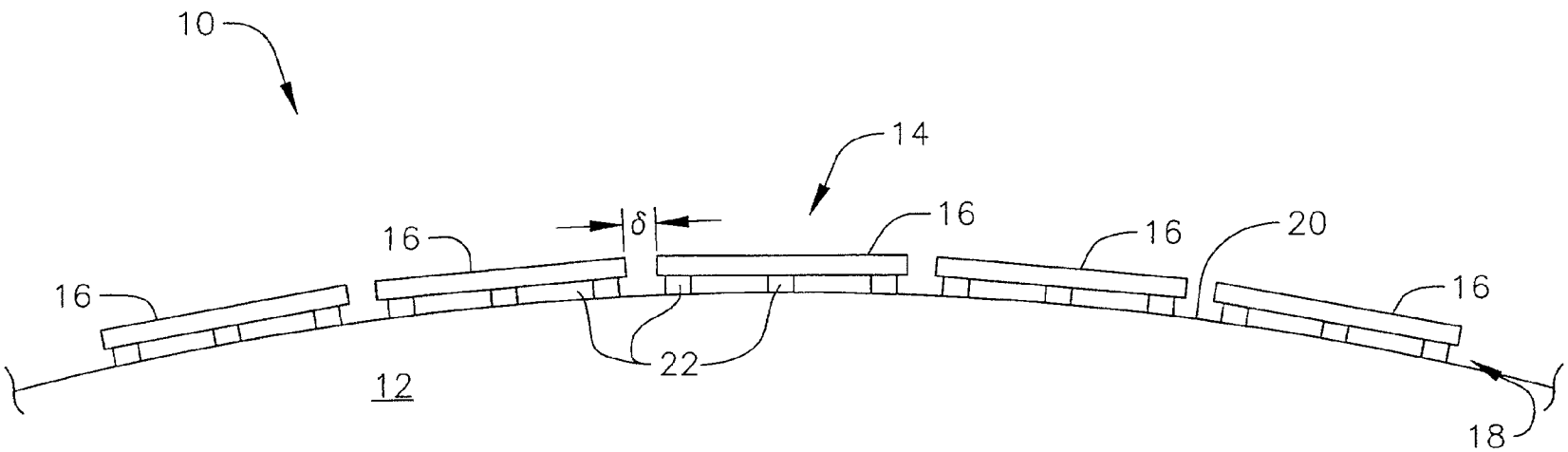
FIG. 1 is a partial end view of an antenna system according to an embodiment of the invention.

An antenna system 10 according to an embodiment of the invention is shown in FIG. 1. In the embodiment shown, the system 10 includes a platform 12, an array 14 of antenna panels 16, and a support structure 18 between the platform 12 and the array 14. The support structure 18 mounts the array 14 to the platform 12. The support structure 18 is sufficiently rigid to support the panels 16 without sagging or bending, but also sufficiently flexible to accommodate the mismatch in thermal expansion between the panels 16 and the platform 12.

In one embodiment, the platform 12 is a high-altitude balloon made of a material such as a polymer film, or laminated layers of high-strength fiber material such as Dyneema® (DSM Dyneema LLC, Stanley, N.C.). The material may be very thin, for example 0.004 inches. This material has a first coefficient of thermal expansion, which indicates the extent to which the material expands with temperature. In one embodiment the coefficient of thermal expansion is approximately −8 ppm/° C. (where ppm is parts per million). That is, the coefficient is negative, meaning that the material actually contracts with increasing temperature. This can cause a large mismatch in linear movement between the platform material and the antenna panels.

In one embodiment, the panels 16 of the antenna array 14 are panels of active or "phased" antenna elements. The entire array 14 includes many panels 16 arranged together, spaced apart from each other by a small distance δ. In one embodiment, δ is approximately 1 inch. In one embodiment each panel is approximately 1 square meter in size. The panels 16 cooperate together to form the aperture of the antenna array. The active antenna elements on the individual panels 16 and the panels themselves are spaced and aligned with each other precisely in order to enable the antenna elements to cooperate together to send and receive signals. In one embodiment, the panels 16 are made up of layers of thin sheets adhered together, such as thin films of liquid crystal polymer (LCP). These thin films are corrugated and adhered together, and may have circuits or other components printed on them. This material has a second coefficient of thermal expansion that is higher than the first coefficient of the balloon material. That is, the panels 16 expand more with increasing temperature than the balloon material expands. In one embodiment, the panel has a coefficient of thermal expansion of approximately 17 ppm/° C. This coefficient is positive, meaning that the panels expand with increasing temperature.

The panels themselves are substantially rigid. In one embodiment, the panels are light-weight antenna panels that are rigid and relatively fragile, such as active electronically scanned array (AESA) panels. These panels have a delicate structure of electrical components and layers of light-weight material. In one embodiment, the panels have a thin film folding structure, including spaced apart sheets and layers acting as a support structure (as indicated by dotted lines in FIG. 3), and these thin layers can be crushed, torn, or damaged under tensile or shear stresses.

In the embodiment shown in FIG. 1, the panels 16 themselves do not contact the surface 20 of the platform 12. Instead, the panels 16 are mounted to the platform 12 and spaced apart from it by the support structure 18. In one embodiment, the support structure 18 includes a plurality of spacer elements 22 and adhesive layers (shown in FIGS. 3 and 4) that adhere the spacer elements to the panels and to the surface 20 of the platform 12. In one embodiment, the panels are mounted to the platform only by the support structure (although the panels may also be electrically connected to components on the platform by other means, such as electrical cables).

Figure 2:
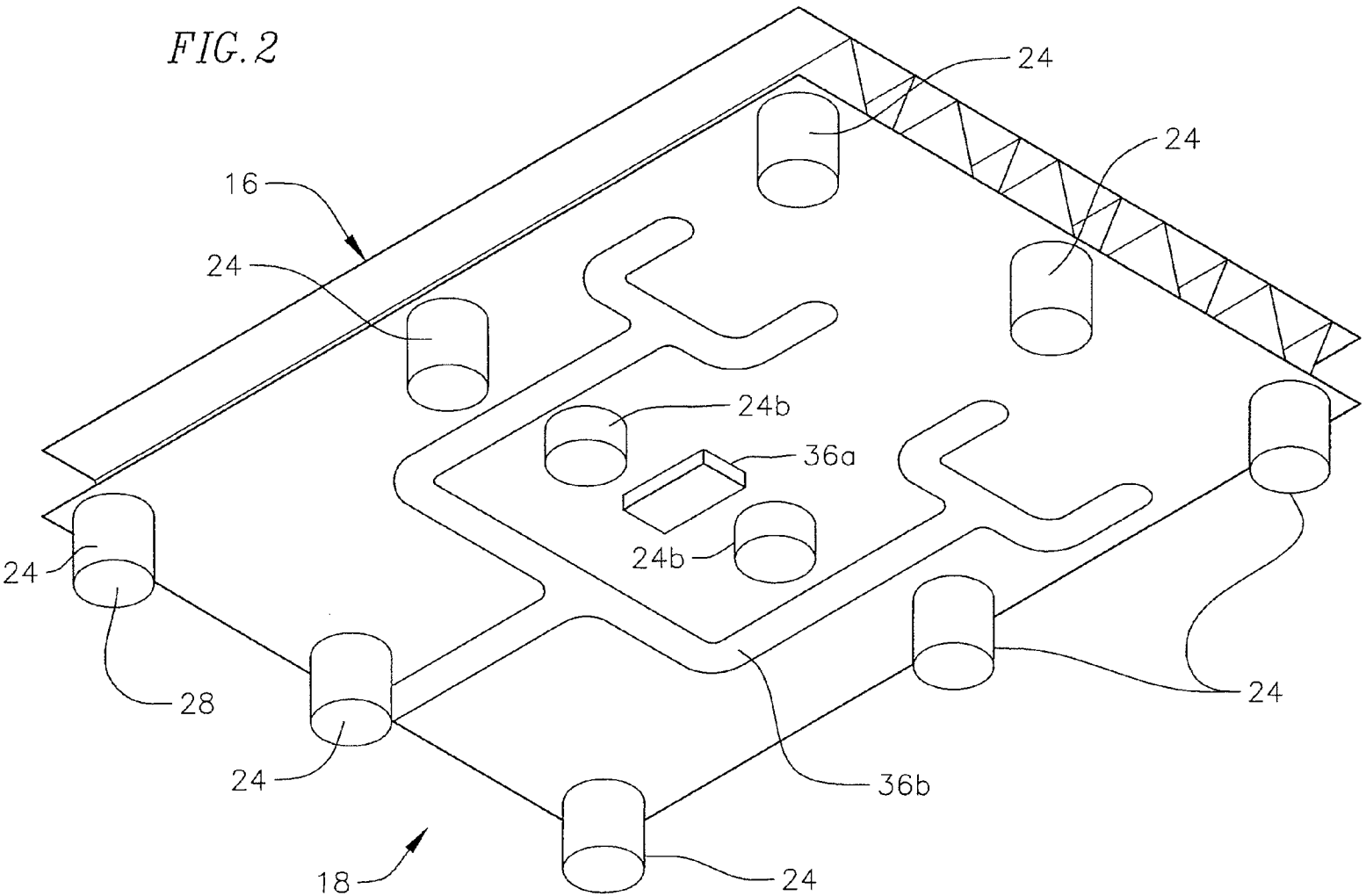
FIG. 2 is a lower perspective view of an antenna panel and support structure according to an embodiment of the invention

In one embodiment, the spacer elements 22 are discrete blocks spaced apart from each other, such as, for example, the cylindrical blocks 24 shown in FIG. 2. Referring again to FIG. 1, these spacer elements 22 fixedly attach the panels 16 to the platform 12. The spacer elements 22 provide discrete points where each panels 16 is fixed to the surface 20. The spacer elements 22 thereby enable the panels 16 to be fixed to the platform 12 at desired locations so that the panels 16 can be aligned with each other. By fixing each panel 16 to the platform 12 at multiple points (using multiple spacer elements 22 for each panel), the panel 16 is fixed in place so that it can be precisely aligned with the neighboring panels. These fixed points also prevent the panels from flexing and bending due to vibrations in the overall structure, as the spacer elements firmly hold the panels in place.

At the same time that the spacer elements 22 fix the panels 16 in place, the spacer elements 22 also provide flexibility, enabling the platform 12 to expand and contract without transmitting this movement directly to the panels 16. The spacer elements 22 lift the panels 16 away from the surface 20 of the platform so that the panels 16 do not actually contact the surface 20. When the platform 12 contracts, the spacer elements 22 absorb some of this movement (strain) without transmitting it to the panels 16. The space between each spacer element 22 also enables the platform 12 to expand or contract without directly affecting the lifted panels 16. When the platform 12 contracts, the spacer elements 22 are stressed, as they adjust between the two mismatched structures 12, 16. However the spacer elements 22 and the adhesive layers (described below) are selected such that these elements can withstand the stress from the thermal mismatch, thereby acting as a buffer between the platform 12 and the panels 16 and insulating the panels from the thermal mismatch.

In one embodiment, the spacer elements 22 are made of a lightweight cellular material, such as a foam material. In one embodiment the material is a rigid, low-density foam, such as polymethacrylimide. This material is light-weight (low density) and stiff, providing a high strength-to-weight ratio.

In one embodiment, the foam material is Rohacell® (Evonik Industries, Darmstadt, Germany), a shear- and pressure-resistant, light-weight foam structure. In particular, Rohacell® P190 was found during testing to provide a sufficient stiffness for supporting the panels 16, while also being able to adjust to expansion and contraction without fracturing. In another embodiment, the material is Rohacell® 200WF.

Figure 3:
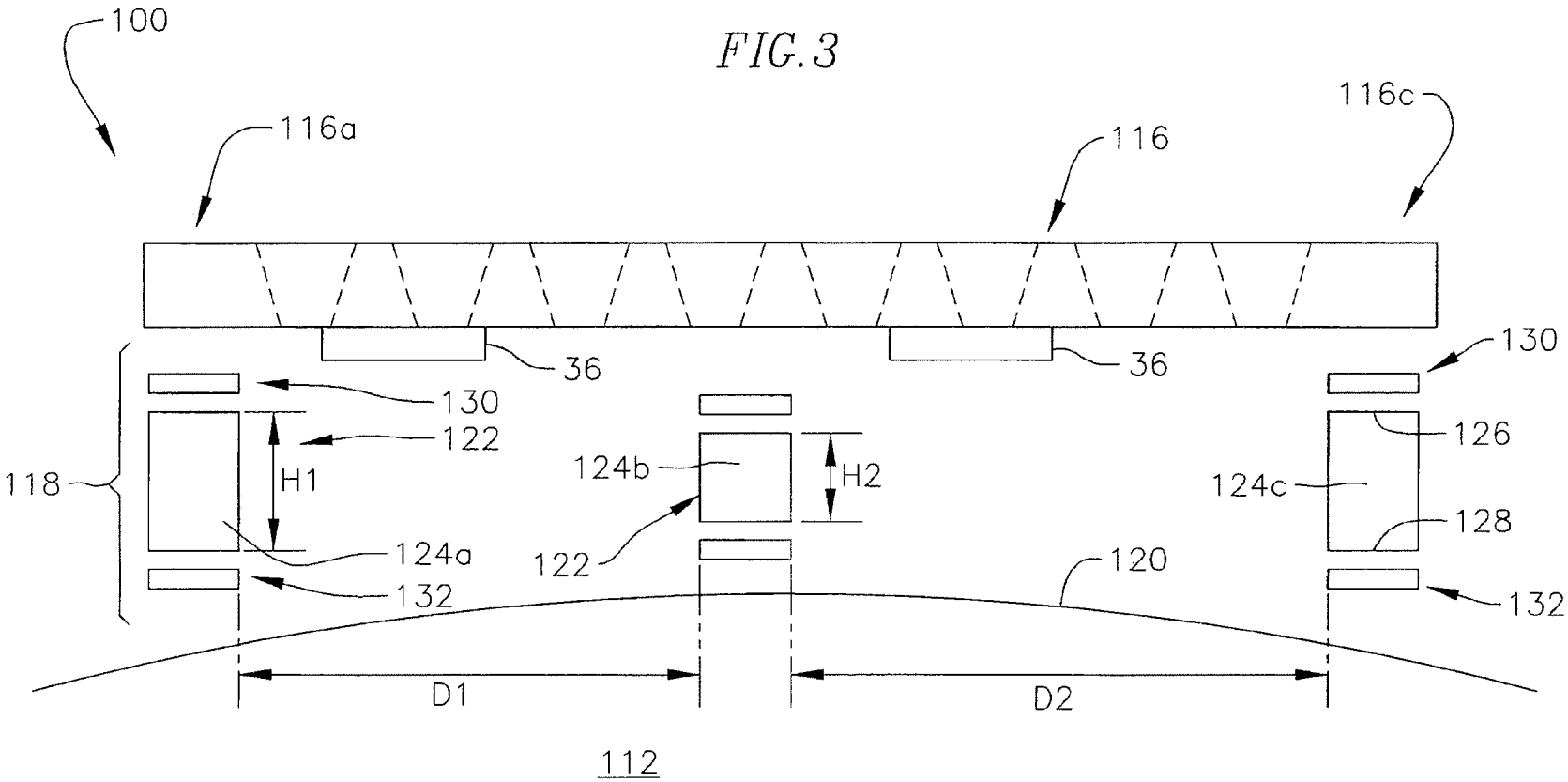
FIG. 3 is a cross-sectional exploded view of an antenna system according to an embodiment of the invention.

In one embodiment, the spacer elements are secured to the platform and to the panels by adhesive, as shown for example in FIG. 3. FIG. 3 shows an exploded cross-sectional view of an antenna system 100 according to an embodiment of the invention. The antenna system 100 includes an antenna panel 116 mounted to a curved surface 120 of a platform 112 by a support structure 118 which includes spacer elements 122 and adhesive layers 130, 132. The spacer elements 122 include three foam blocks 124*a*, 124*b*, 124*c*. The blocks 124*a* and 124*c* are mounted at opposite ends 116*a*, 116*c* of the panel 116. The "end" 116*a,c* does not necessarily mean the very edge of the panel 116, but rather at or near the edge of the panel 116. The end blocks may align with the edge of the panel, or may be spaced inwardly by a small distance for clearance. The central block 124*b* is spaced between the two end blocks 124*a*, 124*c*.

The blocks 124*a-c* are adhered to both the panel 116 and the platform 112. The blocks each have a top surface 126 and a bottom surface 128. In the embodiment of FIG. 3, both the surfaces 126, 128 are relatively flat. The top surface 126 of each block 124*a-c* is adhered to the bottom surface of the panel 116 by an adhesive layer 130. The bottom surface 128 of each block 124*a-c* is adhered to the surface 120 by an adhesive layer 132. In one embodiment, the two adhesive layers 130 and 132 are each the same adhesive material, and are approximately the same amount of adhesive. In one embodiment, the adhesive is a silicone elastomer compound, such as Master SIL 711 (Master Bond Inc., Hackensack, N.J.), which has a coefficient of thermal expansion of approximately 350 ppm/° C. In one embodiment, the adhesive is chosen to be elastic and flexible at low temperature (such as −60 to −80° C.), meaning that it has a large elongation before break. In one embodiment, the adhesive layers 130, 132 have a thickness of approximately 0.004-0.005 inches. In one embodiment, each spacer element is secured to the platform only by the adhesive layer 130.

In one embodiment, the coefficients of thermal expansion of the various materials are listed, from highest to lowest, as follows: the adhesive layers 130, 132, the antenna panels, and the platform material.

In one embodiment, the foam material of the blocks 124*a-c* has a higher yield strength than the adhesive of the layers 130, 132. As a result, the adhesive reaches its yield strength before the foam does, and the adhesive begins to yield. Its elastic modulus is effectively reduced, and the material becomes less stiff. The adhesive is then able to absorb the strain due to the differential expansion of the platform and panels during thermal loading. In one embodiment, the adhesive has a high elongation (such as, for example, above 300%, such as approximately 400%), which enables the adhesive to absorb the strain without failing. The adhesive is a flexible bonding adhesive that remains flexible at low temperature, so that it deforms and adjusts to accommodate movement of the platform, blocks, and panels relative to each other. The adhesive also acts as a damping mechanism, to protect the array from vibrations, and an electrical insulator.

In one embodiment, the adhesive is initially stiffer than the foam, but has a lower yield strength. Once exposed to high strains, the adhesive yields and becomes less stiff. This reduces stress on the foam and allows high strains to be absorbed by the adhesive without failure of the joint. The yield strength of the various materials is the stress at which the material begins to deform plastically, and can be determined through tensile testing (measuring stress and strain as a sample of the material is pulled until it yields or breaks).

Figure 4:
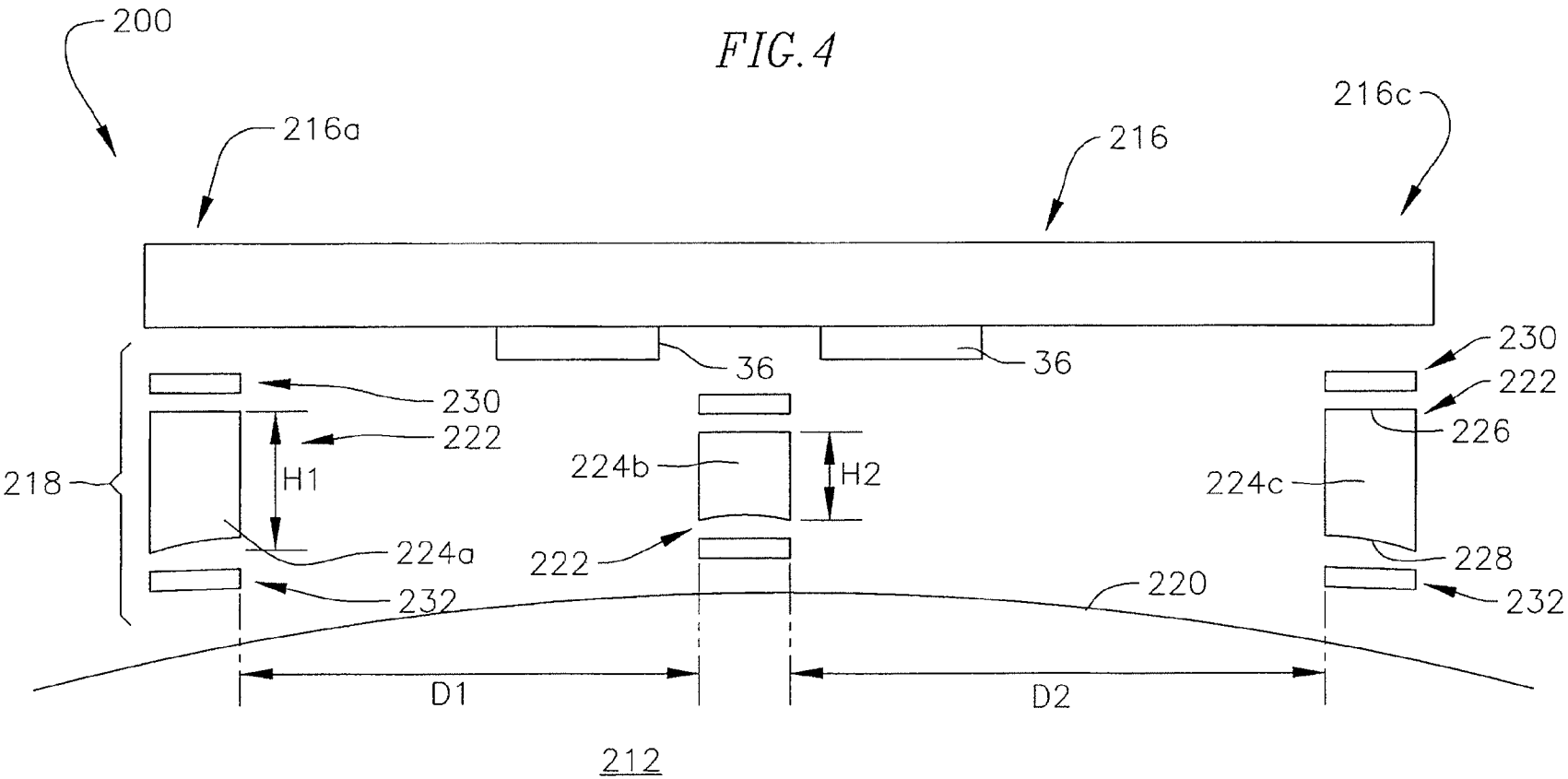
FIG. 4 is a cross-sectional exploded view of an antenna system according to another embodiment of the invention.

In one embodiment, the surface 20 of the platform 12 is curved, as shown in FIGS. 1, 3, and 4. The surface may be curved along a constant or a varying radius. In one embodiment, the curve is very gradual, with a large radius, and is exaggerated in FIGS. 1, 3, and 4 for clarity. Referring to FIG. 3, the surface 120 is curved, but the bottom surfaces 128 of the blocks 124*a-c* are flat. Because the radius of curvature of the surface 120 is large, giving it only a slight curve, the individual surfaces 128 can be adhered to the curved surface 120 even though the surfaces 128 are flat. The adhesive layer 132 also provides some buffer between the two surfaces 120, 128 to accommodate their different shapes.

Another embodiment of the invention is shown in FIG. 4. In this case, an antenna system 200 includes a panel 216 mounted to a platform 212 by a support structure 218. The support structure 218 includes spacer elements 222, which in this embodiment include three blocks 224*a-c*, and adhesive layers 230, 232. These blocks include two end blocks 224*a*, 224*c* and one central block 224*b*. In this embodiment, the blocks 224*a-c* have a flat top surface 226 and a curved bottom surface 228. The flat top surface 226 of each block is adhered to the flat panel 216 by the adhesive layer 230. The curved bottom surface 228 is adhered to the curved surface 220 by the adhesive layer 232. The curved bottom surface 228 is dimensioned to match the curve of the surface 220, so that the two surfaces match when adhered together. Thus, the curvature along the bottom surfaces 228 matches the curvature of the surface 220.

The location and spacing of the blocks 224*a-c* will now be described with reference to FIGS. 3 and 4. The blocks 124/224*a* and 124/224*b* are spaced apart by distance D1, and the blocks 124/224*b* and 124/224*c* by distance D2. In one embodiment, these distances are the same. In other embodiments, these two distances can vary. For example, the exact location of the blocks can be varied based on features on the platform, and/or surface features 36 on the bottom surface of the antenna panel 116, 216. These surface features 36 are shown in FIGS. 3 and 4, extending from the bottom surface of the panel. These features 36 may be electrical components that extend from the antenna panel, or they could be sensitive areas of the panel where the surface of the panel should not be covered by adhesive. Examples of these surface features are also shown in FIG. 2, where the bottom surface of the antenna panel 16 includes an electrical component 36*a* extending out from the panel, as well as sensitive electrical features 36*b* formed in the surface of the panel. The blocks 24 are located on the panel 116 to avoid these features 36*a*, 36*b*. In one embodiment, the blocks 24 are adhered to the panel prior to being adhered to the platform, so that the surface features can be avoided.

Additionally, extra supporting blocks may be provided near, but not directly on, sensitive electrical components in order to provide support for these components and prevent them from sagging and bending. For example, in FIG. 2, two central blocks 24*b* are provided on either side of the electrical component 36*a*. The location and spacing of the blocks can be tailored to the individual panels, depending on their configuration and electrical components.

Referring again to FIGS. 3 and 4, the distances D1 and D2 are chosen to accommodate the features 36 as well as to distribute the blocks evenly across the panel 116, 216 to provide sufficient support to the panel. For example, without the middle block 124*b*, 224*b*, the panel 116, 216 could sag or bend in the middle, straining the layers of the panel and the electrical components of the antenna. Thus sufficient blocks are provided, sufficiently close to each other, to support the panel 116, as well as to firmly mount it to the platform.

The spacing of the blocks 124, 224 also has to account for the desired flexibility of the support structure, to accommodate the thermal mismatch of the panels and the platform, as described above. Thus, if too many blocks are provided, too close to each other, then the expansion or contraction of the platform may be transmitted to the panel. If the blocks are spaced apart, the open space between the blocks provides clearance through which the platform can move without directly affecting the panel. When the size and spacing of the blocks is determined for each panel, the quantity of blocks can be determined, based on the number of panels that make up the entire array.

Tests were conducted to determine an optimal spacing between the spacer element to maintain flexibility and support. Tests were also conducted to determine an optimal spacing based on stresses in the antenna array and the adhesive layers from deflections and vibrations that could be expected in the structure. In one embodiment, the spacing between the spacer elements was approximately 5 inches, and in another embodiment approximately 2 inches. In another embodiment, the spacing was between approximately 2-5 inches. Tests showed that this spacing provides sufficient support for the array, does not interfere with radio frequency signals, and provides flexibility for relative thermal expansion.

The dimensions of the blocks themselves were also tested to determine a size that provided both a flexible spacing away from the platform as well as a rigid and fixed mount to the platform. In one embodiment, the end blocks 124*a*, 224*a*, 124*c*, 224*c* are approximately twice as tall in height as they are in diameter, such as 1 inch in height H1 and ½ inch in diameter, and the central block 124*b*, 224*b* is approximately the same in height and diameter, such as ½ inch in height H2 and ½ inch in diameter. In another embodiment, the end blocks are approximately ¾ inch in height, and the central block is approximately ½ inch in height, with both blocks having a ½ inch diameter. Of course, the blocks need not be cylindrical, and in other embodiments they have other cross-sections with a width of approximately ½ inch. When the surface 120, 220 is curved, the central block can be made shorter than the end blocks, to accommodate the curved shape of the platform (as shown in FIGS. 2-4). In another embodiment, the surface is curved but all blocks have the same height. In another embodiment, the surface is flat, and all blocks have the same height, such as ¾ or ½ inches. In another embodiment the surface has a different shape, and the blocks are tailored to accommodate that shape while keeping the panels flat.

By providing individual, discrete points of attachment for each panel to attach the panel to the platform, the support structure 18, 118, 218 enables each panel to remain flat and level, even while the platform surface 20, 120, 220 is curved. The spacing δ between each panel also enables each panel to sit at a slightly different angle relative to its neighboring panels, to follow the curve of the platform. Optionally, the bottom surface 228 (see FIG. 4) of the support structure spacer element can be curved (or otherwise shaped) to follow the platform's shape.

In one embodiment, the platform 12, 112, 212 is a large, cylindrical, inflated structure, with a radius of approximately 30 m. In one embodiment, the platform 12, 112, 212 is positioned inside a larger balloon, which is deployed at high altitude for surveillance. The balloon operates at an altitude of approximately 65,000 to 80,000 feet. During the balloon's flight, the ambient atmospheric temperature can vary from approximately 25° C. to approximately −80° C. The panels are adhered to the inner cylindrical inflated structure by a support structure that includes foam spacers that lift the panels away from the curved surface while securely fixing them to it. The outer, larger balloon surrounds the inner balloon with the mounted antenna panels, protecting the panels from wind and other environmental elements. The panels are mounted around the circumference of the cylindrical platform structure, so that the antenna points in all directions. In one embodiment, the antenna panels form an active electronically scanned array.

In one embodiment, the surface 20, 120, 220 is an outer-facing surface of the platform 12, 112, 212, such as the exterior surface of a balloon. In another embodiment, the surface is an inner-facing surface of the platform, such as the interior surface of a balloon.

In one embodiment, the materials used in the antenna system are identified as follows and have the following material properties (with two spacer materials identified as options):

TABLE 1

| Component—Material | Elastic Modulus (Msi) | Ultimate Strength (ksi) | Density (lb/in$^3$) | Elongation (%) | Coefficient of Thermal Expansion (ppm/° C.) |
|---|---|---|---|---|---|
| Antenna panel—liquid crystal polymer | 0.327 | 29 | 0.051 | — | 17 |
| Adhesive—Master Bond 711 | 0.0899 | 0.400 | 0.0484 | 400 | 350 |
| Spacer—Rohacell ® 200 WF | 0.0508 | 0.986 | 0.0074 | 3.5 | 0.3 |
| Spacer—Rohacell ® P190 | 0.054 | 1.2 | 0.0069 | 6 | ≈33-37 |
| Platform—laminated Dyneema ® fibers | 16.824 | — | — | — | −8 |

In an embodiment, the elastic modulus of the spacer element is above approximately 0.01 Msi, and in another embodiment between approximately 0.03-0.06 Msi, and in another embodiment approximately 0.05 Msi. In one embodiment, the density of the spacer element is above approximately 0.001 lb/in$^3$, and in another embodiment between approximately 0.005-0.01 lb/in$^3$, and in another embodiment approximately 0.007 lb/in$^3$. In one embodiment, the ultimate strength of the spacer element is above approximately 0.2 ksi, and in another embodiment between approximately 0.5-1.5 ksi, and in another embodiment between approximately 0.9-1.2 ksi, and in another embodiment approximately 1.0 ksi.

In one embodiment, the yield strength of the foam is greater than the yield strength of the adhesive.

Although the present invention has been described and illustrated in respect to exemplary embodiments, it is to be understood that it is not to be so limited, and changes and modifications may be made therein which are within the full intended scope of this invention as hereinafter claimed. For example, the antenna panels may be attached to a structure other than a high-altitude surveillance balloon, and the platform need not be inflatable.

What is claimed is:

1. An antenna structure comprising:

a platform having a first coefficient of thermal expansion;

an antenna panel having a second coefficient of thermal expansion different from the first coefficient, and having first and second opposite ends; and a support structure mounting the panel to the platform, the support structure comprising:

a first spacer element with a first height at the first end of the panel, and a second spacer element with a second height less than the first height between the first and second ends of the panel;

a first adhesive layer adhering each spacer element to the platform; and a second adhesive layer adhering each spacer element to the antenna panel, wherein a yield strength of the adhesive layers is less than a yield strength of the spacer elements.

2. The antenna structure of claim 1, wherein each spacer element is mounted to the platform only by the first adhesive layer.

3. The antenna structure of claim 2, wherein the antenna panel is mounted to the platform only by the support structure.

4. The antenna structure of claim 3, wherein the first spacer element is approximately 1 inch in height and 0.5 inches in diameter, and the second spacer element is approximately 0.5 inches in height and 0.5 inches in diameter.

5. The antenna structure of claim 1, wherein the spacer elements comprise foam.

6. The antenna structure of claim 5, wherein the foam comprises polymethacrylimide.

7. The antenna structure of claim 5, wherein the foam comprises an elastic modulus of approximately 0.05 Msi.

8. The antenna structure of claim 1, wherein the platform comprises a high-altitude balloon.

9. The antenna structure of claim 1, wherein the first adhesive layer comprises an elongation of over 300%.

10. The antenna structure of claim 1, wherein a top surface of each of the first and second spacer elements is flat and a bottom surface of each of the first and second spacer elements is curved.

11. The antenna structure of claim 1, wherein the spacer elements are adhered to a curved surface of the platform.

12. The antenna structure of claim 1, wherein the first spacer element is substantially twice as great in height as in diameter.

13. The antenna structure of claim 1, wherein an elastic modulus of the spacer elements is between approximately 0.03-0.06 Msi.

14. The antenna structure of claim 1, wherein a density of the spacer elements is between approximately 0.005-0.01 $lb/in^3$.

15. The antenna structure of claim 1, wherein an ultimate strength of the spacer element is between approximately 0.5-1.5 ksi.

16. An antenna structure comprising:

a platform having a curved surface;

an array of antenna panels; and first and second blocks mounting each panel to the curved surface, wherein the first and second blocks have first and second heights, respectively, that are different from each other, wherein each block is adhered to the curved surface, wherein the blocks comprise a foam material;

wherein each block is approximately 0.5 inches in width, and wherein the blocks are spaced apart from each other by approximately 2-5 inches.

17. The antenna structure of claim 16, wherein the curved surface is an inner surface of the platform.

18. The antenna structure of claim 16, wherein the curved surface is an outer surface of the platform.

19. A method of mounting an antenna panel to a platform, comprising:

providing a platform having a first coefficient of thermal expansion;

providing an antenna panel having a second coefficient of thermal expansion different from the first coefficient, and having first and second opposite ends; and mounting the panel to the platform, comprising:

providing a first spacer element with a first height at the first end of the panel;

providing a second spacer element with a second height less than the first height between the first and second ends of the panel;

adhering each spacer element to the platform with a first adhesive layer; and adhering each spacer element to the antenna panel with a second adhesive layer, wherein a yield strength of the adhesive layers is less than a yield strength of the spacer elements.

* * * * *